United States Patent [19]

Fiorenza, Sr.

[11] Patent Number: 4,656,778

[45] Date of Patent: Apr. 14, 1987

[54] STORM WINDOW ASSEMBLY

[76] Inventor: Jack Fiorenza, Sr., 326 White Oak Ridge Rd., Short Hills, N.J. 07078

[21] Appl. No.: 914,918

[22] Filed: Oct. 3, 1986

[51] Int. Cl.[4] ..... E05B 65/04

[52] U.S. Cl. ..... 49/63; 160/9 D; 49/501; 49/453

[58] Field of Search ..... 49/62, 63, 404, 501, 49/453; 160/90, 91

[56] References Cited

U.S. PATENT DOCUMENTS

| | | | |
|---|---|---|---|
| 2,640,535 | 6/1953 | Milone | 49/63 X |
| 2,659,943 | 11/1953 | Polson et al. | 49/63 |
| 3,269,452 | 8/1966 | Pirozzi | 49/63 X |
| 3,587,705 | 6/1971 | Zappone | 160/91 |
| 4,186,522 | 2/1980 | Hooks | 49/63 |
| 4,314,598 | 2/1982 | Roesch | 160/90 |
| 4,432,163 | 2/1984 | Cassiere | 49/63 |

*Primary Examiner*—Kenneth Downey
*Attorney, Agent, or Firm*—Norman B. Rainer

[57] ABSTRACT

A storm window assembly is provided for easy installation upon the exterior surface of the frame of a prime window of a building. The assembly is comprised of four track-like pathways adapted to slideably engage four storm window sashes and a screen sash. The pathways are of progressively larger rectangular perimeter going from the exterior to the interior borders of the frame, thereby permitting easy removal of the sashes for cleaning purposes. The several sashes have about half the height of the frame, and are arranged in a manner to create a dead air space within the assembly. A flange and associated resilient gasket is disposed outwardly from the frame in a manner to permit weatherproof abutment with the frame of the prime window without need for caulking.

5 Claims, 5 Drawing Figures

STORM WINDOW ASSEMBLY

BACKGROUND OF THE INVENTION

This invention concerns a storm window assembly having several window and screen members slideably retained in a multi-track rectangular frame.

Various types of storm windows are in widespread use. The storm windows are designed to be installed in association with the sash frame of prime windows to form a thermal barrier which minimizes conductive and convective heat transfer between a building and the surrounding outside air.

Some styles of storm window are difficult to install in a functionally effective manner, and once installed are not easily transferrable to another building. Other types of storm windows are either of expensive construction, difficult to manipulate, or are of minimal effectiveness as a thermal barrier.

It is accordingly an object of the present invention to provide an easily installable storm window capable of easy removal for subsequent use.

It is another object of this invention to provide a storm window as in the foregoing object having high thermal barrier effectiveness and capable of easy manipulative handling.

It is a further object of the present invention to provide a storm window of the aforesaid nature of simple construction and amenable to low cost manufacture.

These objects and other objects and advantages of the invention will be apparent from the following description.

SUMMARY OF THE INVENTION

The above and other beneficial objects and advantages are accomplished in accordance with the present invention by a storm window assembly designed to be installed in abutment with the exterior surface of the sash of a prime window, said assembly comprising:

(a) a rectangular frame, the sides of which are comprised of a pair of parallel long jamb members having upper and lower extremities, and shorter header and sill members in facing horizontal disposition at the upper and lower extremities, respectively, of said jamb members, said sides defining interior and exterior borders of the assembly and being comprised of four lengths of an aluminum extrusion having been cut and joined at 45 degree angles at the corners of the frame, (b) first, second, third and fourth storm window sashes of sequentially increasing size, and a screen sash, said sashes being of rectangular shape and having heights of about half the height of said frame measured between the sill and the header, the upper extremities of said sashes having paired laterally directed bearing posts which engage said jambs to permit sliding movement of the sash within the jambs and permit removal of the sashes from the jambs by the manual lifting of the lower extremity of the sashes in the direction of the interior border in pivotal movement about said bearing posts followed by the tilting of the upper extremity of the sash within a vertical plane, the lower extremities of the sashes having paired latch means which slideably engage said jambs, (c) said aluminum extrusion having:

(1) an interior flat border surface, (2) an exterior flat border surface spaced apart from said interior border surface in a plane parallel thereto but displaced therefrom laterally with respect to the long direction of the extrusion, (3) a connecting wall extending between said interior and exterior border surfaces, (4) first, second, third and fourth track means adapted to slideably receive said bearing posts and having lower extremities which are closed by said connecting wall, and open upper extremities, said first track lying adjacent said exterior border surface and said second, third and fourth tracks lying in contiguous succession, placing the fourth track adjacent the interior border surface, said succession being a stepwise array wherein each track is laterally displaced from adjacent tracks, and (5) a flange strip disposed on the opposite side of said connecting wall from said tracks and disposed between said interior and exterior border surfaces in parallel disposition thereto, (d) the four lengths of said aluminum extrusion constituting the sides of said frame being interconnected in a manner whereby the first, second, third and fourth track means of each side are in vertical coplanar alignment, directing the open upper extremities of the tracks toward the center of the frame, thereby forming continuous rectangular first, second, third and fourth pathways which accommodate said first, second, third and fourth storm window sashes, respectively, and said screen sash sharing said first pathway with said first storm window sash.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
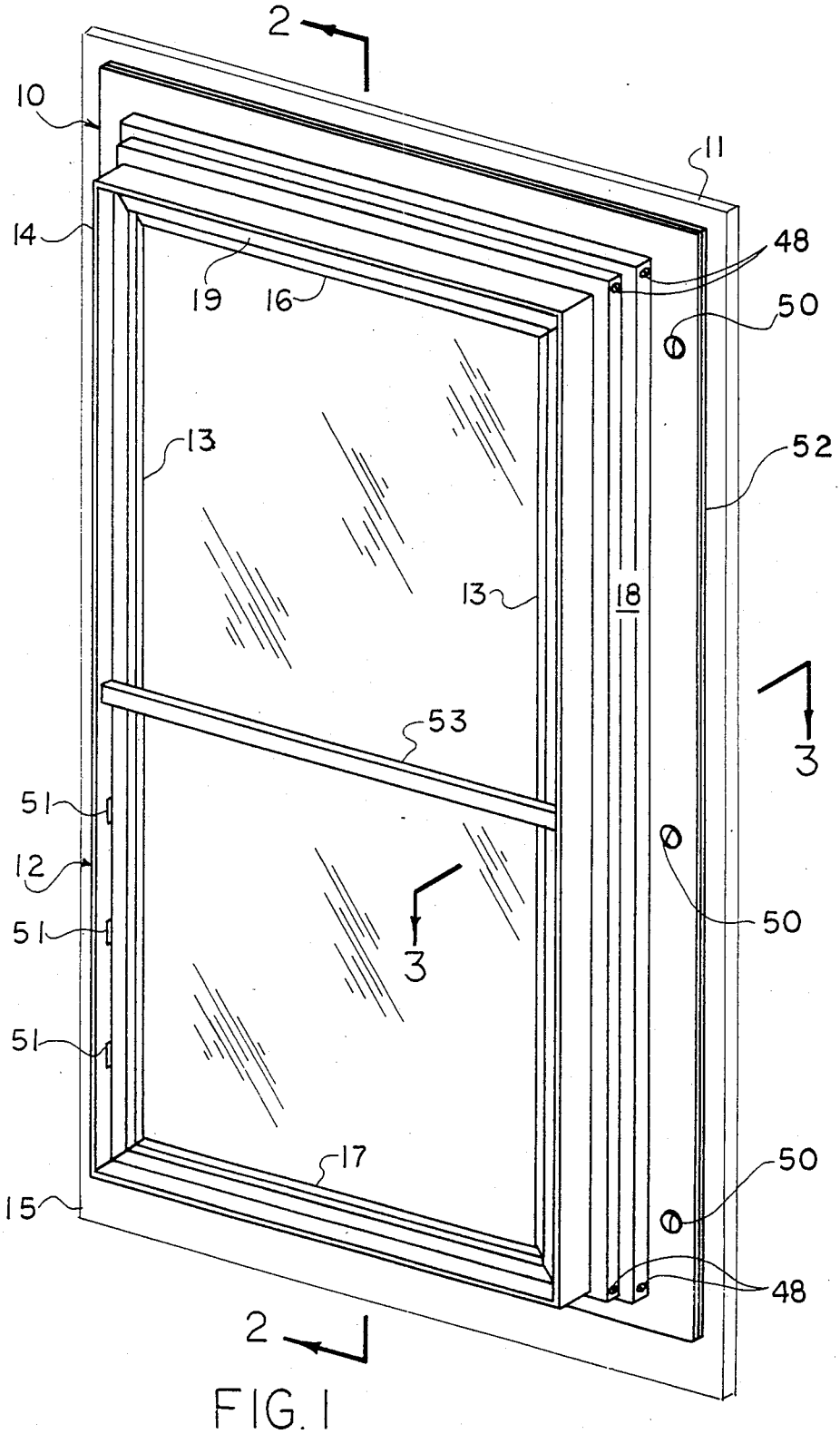
FIG. 1 is a perspective view of an embodiment of the storm window assembly of the present invention, viewed from the exteriorly directed portion thereof.

Referring to FIG. 1, a storm window assembly 10 of this invention is shown mounted upon the frame 11 of a prime window and viewed from the exterior of the building containing said prime window. The assembly is comprised of rectangular frame 12, the sides of which are comprised of a pair of parallel long jamb members 13 having upper and lower extremities 14 and 15, respectively, and shorter header and sill members 16 and 17, respectively, in facing horizontal disposition at the upper and lower extremities, respectively, of said jamb members.

Figure 2:
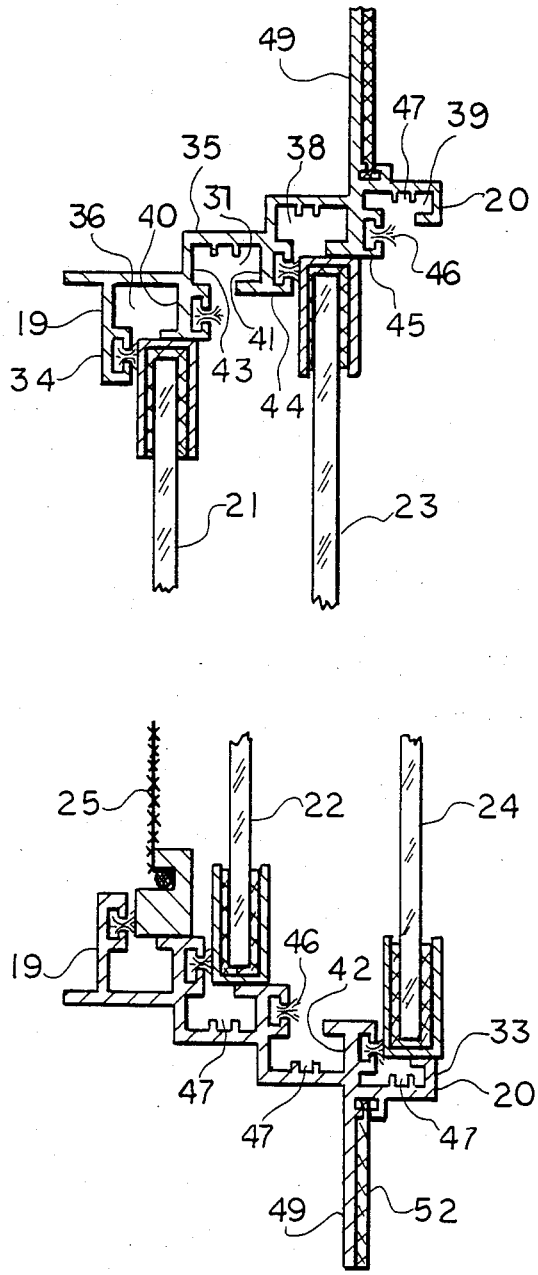
FIG. 2 is an enlarged fragmentary vertical sectional view taken along the line 2—2 of FIG. 1.
Figure 3:
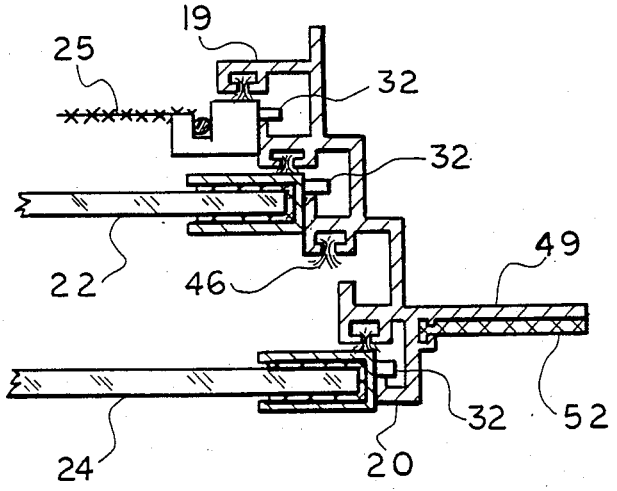
FIG. 3 is an enlarged fragmentary horizontal sectional view taken along the line 3—3 of FIG. 1.
Figure 5:
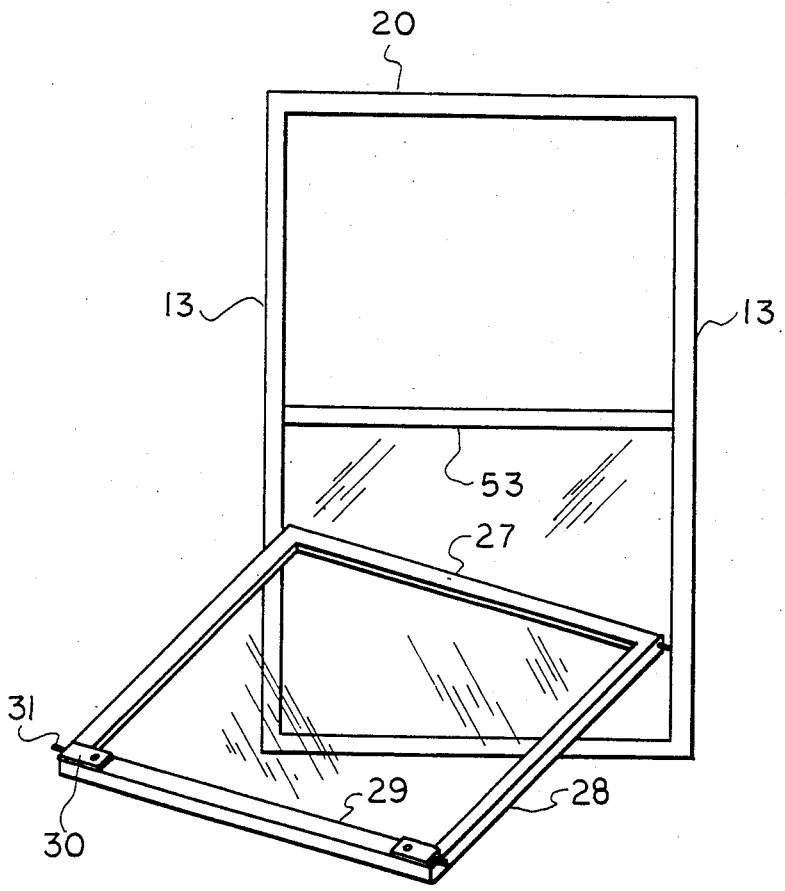
FIG. 5 is a fragmentary perspective view of the assembly of FIG. 1 illustrating the manner in which a storm window or screen sash is removed therefrom.

Each of the side members of said frame is comprised of a straight length of the same aluminum extrusion 18, said straight lengths being joined at 45 degree angles at the corners of the frame and defining exterior border 19 and interior border 20, as best shown in FIGS. 2, 3 and 5. The cross-sectional configuration of the extrusion is shown in FIGS. 2 and 3.

Figure 4:
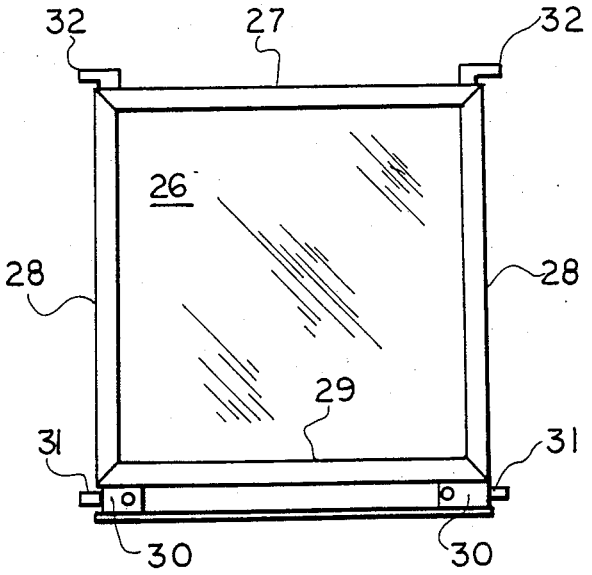
FIG. 4 is a front elevation view of a storm window sash utilized in the assembly of FIG. 1.

First, second, third and fourth rectangular storm window sash members 21, 22, 23 and 24, respectively, of sequentially increasing size are slideably held by said jambs. A screen sash member 25 is also slideably held by said jambs. The window and screen sash members in general have about half the height of the frame measured between the sill and header. As best shown in FIG. 4, each sash member is comprised of a window or screen panel 26, upper moulding 27, vertical side mouldings 28, and lower moulding 29. The upper and side mouldings may be identical and may be of solid or hollow cross-sectional configuration. Lower moulding 29 is of greater width than the upper and side mouldings and has a recessed cross-sectional configuration adapted to accommodate paired spring-urged locking means 30 of conventional design having tabs 31 adapted to travel laterally from the sash member into slideable engagement within said jamb members. The upper mouldings of said sash members are provided with laterally directed bearing posts 32 which slideably engage the jamb members.

As best shown in FIGS. 2 and 3, the aluminum extrusion 18 has an interior flat border surface 33 which, in the assembled frame, forms interior border 20, and exterior flat border surface 34 which forms exterior border 19. Interior and exterior border surfaces, 33 and 34, respectively, lie in parallel planes but laterally displaced with respect to the long direction of the extrusion. A contoured connecting wall 35 extends between said interior and exterior border surfaces.

First, second, third and fourth track means 36, 37, 38 and 39 are disposed upon said connecting wall which constitutes the closed lower extremity of each track means. The first track means is defined in part by exterior border surface 34 and first separator panel 40 rising perpendicularly from said connecting wall in parallel relationship to border surface 34. The second track means is similarly defined in part by said first separator panel and second separator panel 41. The third track means is defined in part by said second separator panel and third separator panel 42. The fourth track means is defined in part by said thick separator panel and interior border surface 33. Each track means has an open upper extremity defined by facing shelf and ledge panels 43 and 44, respectively. The shelf and ledge panels associated with a given separator panel are disposed one above the other, forming a channel 45 which accommodates a strip of felt 46, plastic or similar material serving to prevent metal-to-metal contact with the several sashes and to act as a weatherstrip. Holding grooves 47 disposed within the lower extremity of each track means receive metal screws 48 which facilitate joinder of the four lengths of the extrusion at the corners of the frame. A flat flange strip 49 is disposed on the opposite side of said connecting wall from said tracks in a plane parallel to said interior and exterior border surfaces. Said flange strip is provided with apertures which permit penetrative insertion of screws 50 which mount the storm window assembly onto the frame of the prime window. The inwardly directed surface of flange strip 49 is provided with a resilient flat gasket material 52 which forms a weather-resistant seal with prime window frame 11. Accordingly, weatherproofing caulking customarily employed for the installation of storm windows is not required for the installation of the storm window assembly. The avoidance of caulking not only reduces installation cost but permits removal of the assembly, should such removal be contemplated.

The four lengths of the aluminum extrusion are assembled using metal screws 48 and interactive holding grooves 47 to form frame 12, the extrusion lengths being brought together at a mitered 45 degree angle at the corners of the frame. The frame is formed in a manner such that the first, second, third and fourth track means of each length of extrusion are in vertical coplanar alignment, and the open upper extremities of the track means are directed toward the center of the frame. In such manner of assembly, the track means form continuous first, second, third and fourth rectangular pathways which accommodate said first, second, third and fourth storm window sashes, respectively. The screen sash shares said first pathway with said first storm window, the screen sash preferably occupying the lower half of the frame. The sashes are slideably constrained within the track means of the jambs by entrance of bearing posts 32 and tabs 31 into the open upper extremities of the track means. A stabilizer bar 53 extends horizontally between the jambs at the midpoint of the frame in substantially coplanar relationship with exterior border 19. The stabilizer bar strengthens the frame without impairing the fuctionality or appearance of the storm window assembly. Although the exemplified embodiment of the frame is made from four sections of the same extrusion, other embodiments may utilize a modified type of extrusion as the sill member.

By virtue of the described construction of the storm window assembly, it is seen that two window layers may occupy the entire frame, thereby providing much greater insulative effect than a single window layer. In particular, the double layer effect is achieved, as shown in FIG. 2, when the first and third window sashes are in their uppermost position within the frame, and the second and fourth window sashes are in their lowermost positions. To facilitate positioning of the window sashes at fixed positions above the sill member, holding notches 51 are disposed within the interior borders of the jamb members.

Removal of the several sashes is accomplished, as shown in FIG. 5, by releasing the locking means 30 of the most interiorly directed sash, lifting the lowermost edge upward in pivotal motion about bearing posts 32, then tilting the uppermost edge of the sash downwardly within its pathway until the bearing posts leave the pathway. The several sashes are successively removed in such manner beginning with the most inwardly directed sash in said fourth pathway.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A storm window assembly adapted to be installed in abutment with the exterior surface of the frame of a prime window of a building, said assembly comprising:

(a) a rectangular frame, the sides of which are comprised of a pair of parallel long jamb members having upper and lower extremities, and shorter header and sill members in facing horizontal disposition at the upper and lower extremities, respectively, of said jamb members, said sides defining interior and exterior borders of the assembly and being comprised of four lengths of an aluminum extrusion having been cut and joined at 45 degree angles at the corners of the frame, (b) first, second, third and fourth storm window sashes of sequentially increasing size, and a screen sash, said sashes being of rectangular shape and having heights of about half the height of said frame measured between the sill and the header, the upper extremities of said sashes having paired laterally directed bearing posts which engage said jambs to permit vertical sliding movement of the sash within the jambs and permit removal of the sashes from the jambs by the manual lifting of the lower extremity of the sashes in the direction of the interior border in pivotal movement about said bearing posts followed by the tilting of the upper extremity of the sash within a vertical plane, the lower extremities of the sashes having paired latch means which slideably engage said jambs, (c) said aluminum extrusion being comprised of:

(1) an interior flat border surface, (2) an exterior flat border surface spaced apart from said interior border surface in a plane parallel thereto but displaced therefrom laterally with respect to the long direction of the extrusion, (3) a connecting wall extending between said interior and exterior border surfaces, (4) first, second, third and fourth track means adapted to slideably receive said bearing posts and having lower extremities closed by said connecting wall, and open upper extremities, said first track means lying adjacent said exterior border surface and said second, third and fourth tracks lying in contiguous succession, placing the fourth track adjacent the interior border surface, said succession being a stepwise array wherein each track is laterally displaced from adjacent tracks, and (5) a flange strip disposed on the opposite side of said connecting wall from said track means and disposed between said interior and exterior border surfaces in parallel disposition thereto, (d) the fourth lengths of said aluminum extrusion constituting the sides of said frame being interconnected in a manner whereby the first, second, third and fourth track means of each side are in vertical coplanar alignment, directing the open upper extremities of the track means toward the center of the frame, thereby forming continuous rectangular first, second, third and fourth pathways which accommodate said first, second, third and fourth storm window sashes, respectively, and said screen sash sharing said first pathway with said first storm window sash.

2. The storm window assembly of claim 1 wherein said fourth lengths of an aluminum extrusion are of identical cross-sectional configuration.

3. The storm window assembly of claim 1 wherein the four lengths of aluminum extrusion are assembled using metal screws which engage holding grooves associated with the lower extremities of said track means.

4. The storm window assembly of claim 1 wherein weatherstrip material is associated with each track means to prevent adjacent sashes form contacting each other.

5. The storm window assembly of claim 1 wherein a resilient flat gasket is associated with said flange strip in a manner to abut the exterior surface of the frame of said prime window.

* * * * *